US011767720B2

(12) United States Patent
Hill et al.

(10) Patent No.: US 11,767,720 B2
(45) Date of Patent: Sep. 26, 2023

(54) APPARATUS AND METHODS OF HANDLING A TUBULAR

(71) Applicant: Weatherford Technology Holdings, LLC, Houston, TX (US)

(72) Inventors: Troy F. Hill, Lafayette, LA (US); Joseph P. Benoit, Lafayette, LA (US); Joseph P. Breaux, Youngsville, LA (US); Bryan Doucet, Crowley (LA)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 16/850,495

(22) Filed: Apr. 16, 2020

(65) Prior Publication Data

US 2020/0378198 A1 Dec. 3, 2020

Related U.S. Application Data

(60) Provisional application No. 62/834,903, filed on Apr. 16, 2019.

(51) Int. Cl.

| | |
|---|---|
| ***E21B 19/16*** | (2006.01) |
| ***E21B 19/07*** | (2006.01) |
| ***E21B 19/10*** | (2006.01) |

(52) U.S. Cl.

CPC ..... *E21B 19/16* (2013.01); *E21B 19/07* (2013.01); *E21B 19/10* (2013.01)

(58) Field of Classification Search

CPC ..... E21B 19/16; E21B 19/20; E21B 17/1035; E21B 19/00; E21B 19/07; E21B 19/165; E21B 19/24; E21B 41/0021; E21B 19/06; E21B 19/08; E21B 19/10; E21B 21/02; E21B 19/004; E21B 19/086; E21B 19/09; E21B 19/166

See application file for complete search history.

(56) References Cited

U.S. PATENT DOCUMENTS

| | | | |
|---|---|---|---|
| 4,605,077 | A | 8/1986 | Boyadjieff |
| 5,390,568 | A | 2/1995 | Pietras |
| 5,664,310 | A | 9/1997 | Penisson |
| 5,850,877 | A | 12/1998 | Albright et al. |
| 6,056,060 | A | 5/2000 | Abrahamsen et al. |
| 7,370,707 | B2 | 5/2008 | McDaniel et al. |
| 7,451,826 | B2 | 11/2008 | Pietras |

(Continued)

FOREIGN PATENT DOCUMENTS

| | | | | |
|---|---|---|---|---|
| GB | 2480396 A | * | 11/2011 | ..... E21B 21/106 |
| WO | WO-02086279 A1 | * | 10/2002 | ..... E21B 19/02 |

(Continued)

OTHER PUBLICATIONS

Weatherford; Hands-Free System Makes Up and Racks Casing Without Interrupting Drilling, Reduces Casing Running Time and Drilling Floor Hazards; 2015, 1 page handout.

*Primary Examiner* — James G Sayre

(74) *Attorney, Agent, or Firm* — Smith IP Services, P.C.

(57) ABSTRACT

A tubular gripping tool for gripping a tubular includes a housing; a mandrel disposed in the housing; a plurality of slips movable along the mandrel; and an engagement member disposed in the housing and movable relative to the mandrel, wherein the engagement member is configured to apply a force against the tubular.

21 Claims, 3 Drawing Sheets

(56) References Cited

U.S. PATENT DOCUMENTS

| | | | | |
|---|---|---|---|---|
| 2004/0216924 | A1* | 11/2004 | Pietras | E21B 19/07<br>166/380 |
| 2005/0098352 | A1* | 5/2005 | Beierbach | E21B 19/06<br>175/57 |
| 2009/0274544 | A1* | 11/2009 | Liess | E21B 19/16<br>414/800 |
| 2011/0147010 | A1* | 6/2011 | Ellis | E21B 19/16<br>166/380 |
| 2020/0173241 | A1* | 6/2020 | Olah | E21B 19/07 |

FOREIGN PATENT DOCUMENTS

| | | | | |
|---|---|---|---|---|
| WO | WO-2009135223 | A2 * | 11/2009 | E21B 19/06 |
| WO | WO-2009137516 | A1 * | 11/2009 | E21B 19/16 |
| WO | WO-2014056092 | A1 * | 4/2014 | E21B 19/16 |

* cited by examiner

APPARATUS AND METHODS OF HANDLING A TUBULAR

CROSS-REFERENCE TO RELATED APPLICATIONS

This application claims benefit of U.S. Provisional Patent Application Ser. No. 62/834,903, filed on Apr. 16, 2019, which application is incorporated herein by reference in its entirety.

BACKGROUND

Field

Embodiments of the present disclosure relate to methods and apparatus for handling tubulars. Particularly, the disclosure relates to an elevator for gripping a tubular.

Description of the Related Art

It is known in the industry to use a tubular handling tool to grip a tubular. The tubular handling tool may be connected to and rotated by a top drive. The tubular handling tool includes movable gripping elements for gripping the tubular. The tubular handling apparatus may be referred to as internal or external gripping tools depending on whether the tool grips an internal surface or an external surface of the tubular.

Some of the tubular handling tools may use wedge type slips to grip the tubular. In the case of an internal gripping tool, the wedge slips are moved downward along a mating wedge surface to urge the wedge slips radially outward into contact with the interior surface of the tubular. Because the slips are disposed inside the tubular, it may be difficult to confirm the slips have properly gripped the tubular.

There is, therefore, a need for an apparatus for verifying the slips of the gripping tool are gripping the tubular.

SUMMARY OF THE DISCLOSURE

A tubular gripping tool for gripping a tubular includes a housing; a mandrel disposed in the housing; a plurality of slips movable along the mandrel; and an engagement member disposed in the housing and movable relative to the mandrel, wherein the engagement member is configured to apply a force against the tubular.

In another embodiment, a method of gripping a tubular includes moving a slip to grip the tubular; moving an engagement member into contact with the tubular; causing the engagement member to apply a force against the tubular; and detecting whether the engagement member has moved beyond a predetermined distance relative to the slip after applying the force.

In another embodiment, a method of connecting a first tubular to a second tubular includes gripping the first tubular using a slip; moving an engagement member into contact with the first tubular and applying a force against the first tubular by the engagement member; and detecting whether the engagement member has moved beyond a predetermined distance relative to the slip after applying the force; and connecting the first tubular to the second tubular.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION OF THE PREFERRED EMBODIMENT

Figure 1:
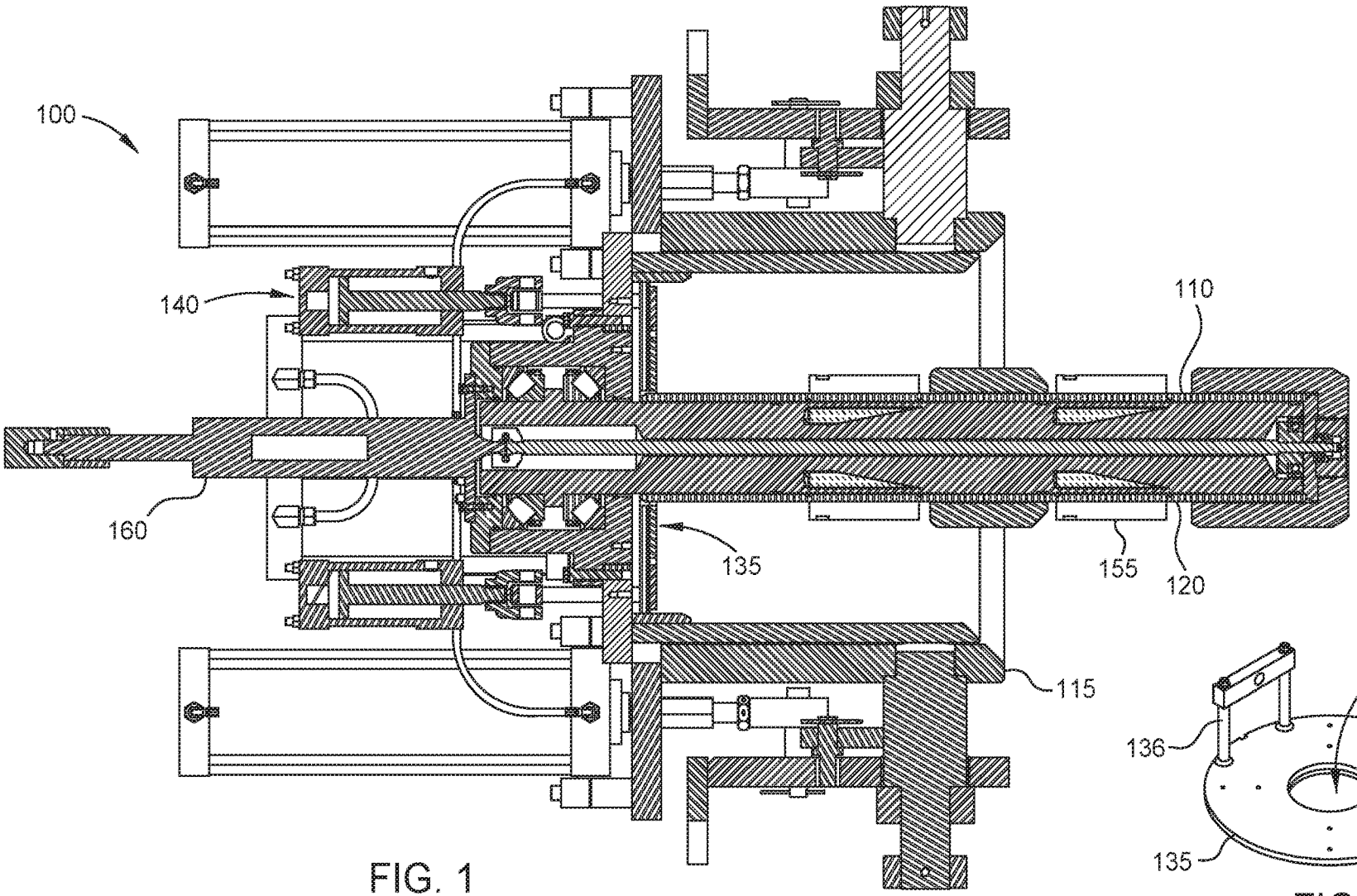
FIG. 1 is a cross-sectional view of an exemplary internal gripping tool.
Figure 2:
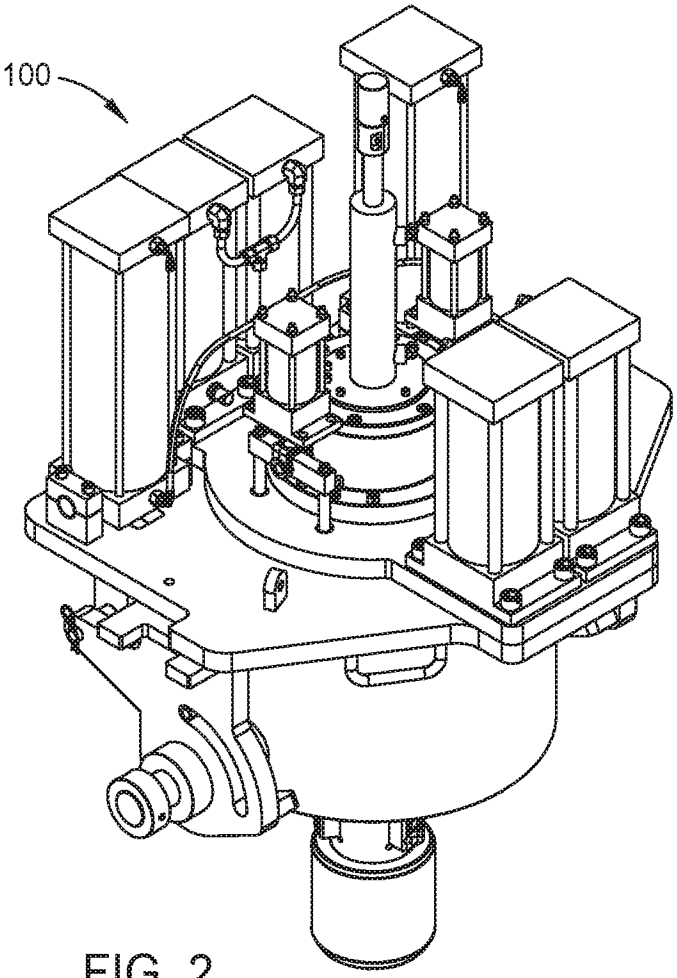
FIG. 2 is a perspective view of the tool.

FIG. 1 is a cross-sectional view of an exemplary internal gripping tool 100. FIG. 2 is a perspective view of the gripping tool 100. In some embodiments, the internal gripping tool 100 is attached to a bail coupled to a rig or a top drive attached to a rig. The internal gripping tool 100 is rotatable relative to the bail for alignment with a tubular to be picked up, which may be in a vertical or inclined position. The gripping tool 100 may be referred to as an elevator.

Figure 5:
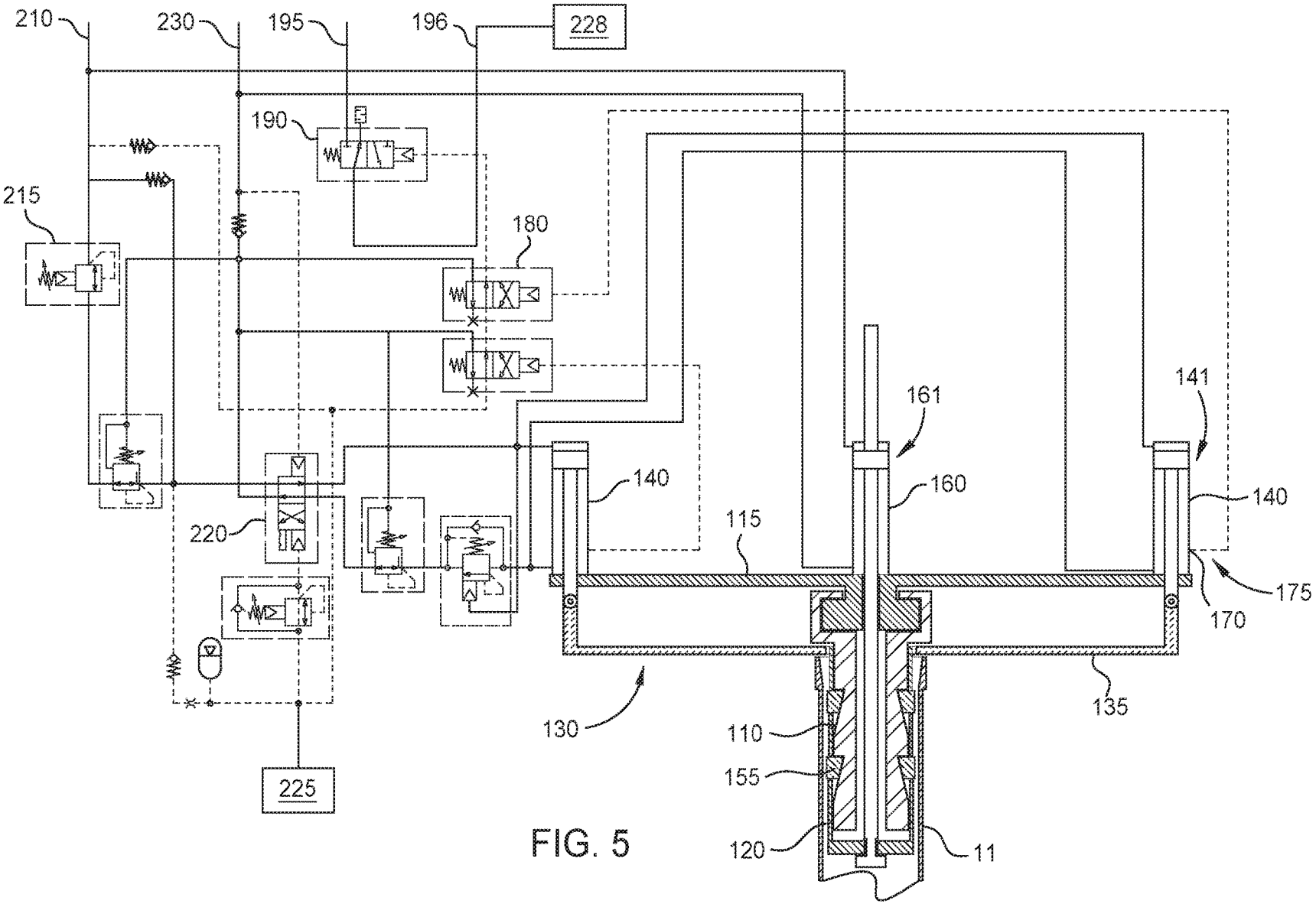
FIG. 5 is a schematic view of the gripping tool.

The internal gripping tool 100 includes a housing 115 and a mandrel 110 disposed in the housing 115. In this embodiment, the mandrel 110 extends below the housing 115. In some embodiments, the housing 115 may include a housing chamber for receiving an upper end of the tubular 11, as shown in FIG. 1. In some embodiments, the housing 115 may include a flat plate, as shown in FIG. 5. A plurality of gripping elements 155 are disposed on the exterior of the mandrel 110 and are connected via an actuation sleeve 120. The actuation sleeve 120 is disposed around the exterior of the mandrel 110. The actuation sleeve 120 is configured to move the gripping elements 155 along an inclined surface of the mandrel 110. A gripping actuator 160 attached to the top of the housing 115 is used to actuate the gripping elements 155. An exemplary gripping actuator 160 is a piston and cylinder assembly. The rod of the piston 161 of the gripping actuator 160 extends through the mandrel 110 and is coupled to the lower portion of the actuation sleeve 120. FIG. 5 is a schematic view of the gripping tool 100. In this respect, extension of the piston 161 will move the actuation sleeve 120 downward relative to the mandrel 110. In turn, the gripping elements 155, such as slips, are moved downwardly and outwardly along the incline of the mandrel 110 to engage the interior surface of the tubular 11, such as a casing. Retraction of the piston 161 will move the actuation sleeve 120 upward relative to the mandrel 110. In turn, the gripping elements 155 are moved inwardly along the incline of the mandrel 110 to disengage from the tubular 11. In some embodiments, the mandrel 110 and the actuation sleeve 120 are rotatable relative to the housing 115 using, for example, bearings.

Figure 3:
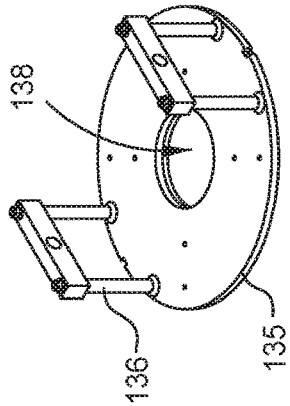
FIG. 3 shows an exemplary engagement member.
Figure 4:
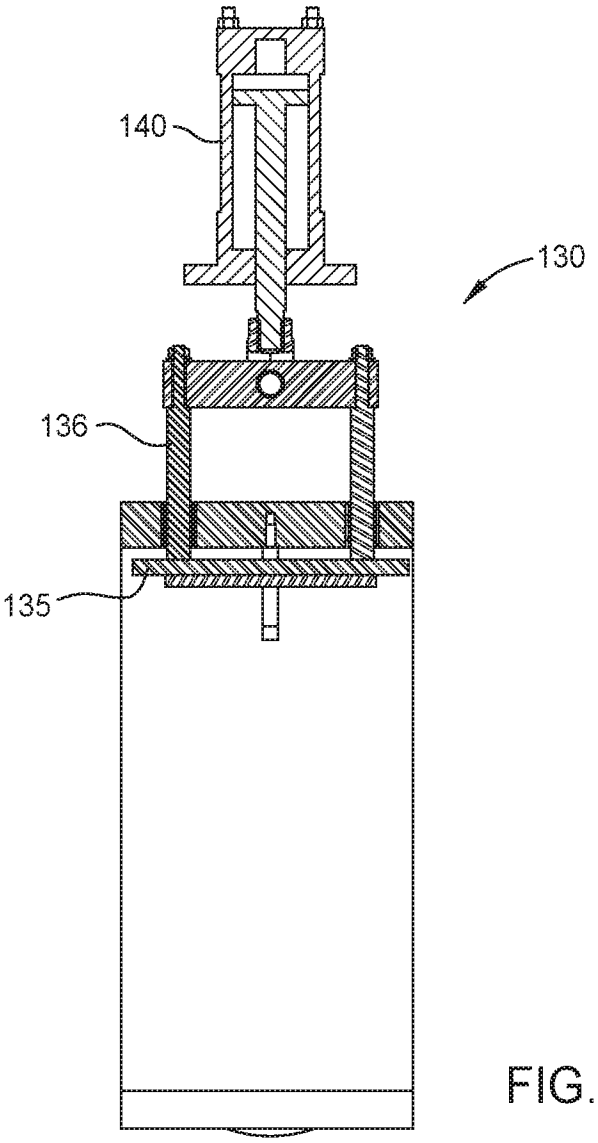
FIG. 4 is a partial, cross-sectional view of the engagement actuator and the engagement member.

Referring to FIG. 1 and FIG. 5, the gripping tool 100 includes a gripping verification system 130 for ensuring the gripping elements 155 are properly engaged with the tubular 11. In various embodiments, the system 130 includes an engagement member 135 and one or more engagement actuators 140, such as a piston and cylinder assembly. FIG. 3 shows the engagement member as an engagement plate 135. The engagement plate 135 includes adapter arms 136 for attachment to the engagement actuators 140. In the example shown, the engagement plate 135 is circular and includes a central hole 138, giving the engagement plate 135 an annular configuration. Central hole 138 can accommodate the mandrel 110, which is disposed through hole 138 as shown in FIG. 1. In some embodiments, the hole 138 is large enough to accommodate the actuation sleeve 120. The engagement actuator 140 is configured to move the engagement plate 135 axially along the mandrel 110. FIG. 4 is a partial, cross-sectional view of the engagement plate 135 and the engagement actuator 140. Engagement plate 135 may be disposed in or below the housing 115, and engagement actuator 140 is disposed on or above the housing 115, opposite the plate 135. Adapter arms 136 extend through the housing 115. FIGS. 1, 4, and 5 show the engagement plate 135 in the retracted position. As shown in FIG. 5, when the mandrel 110 is inserted into the tubular 11, the engagement plate 135 is positioned above the top of the tubular 11. In this example, the engagement plate 135 is positioned above the coupling of the tubular 11. The engagement actuators 140 can be extended to move the engagement plate 135 longitudinally into contact with the top of the tubular 11. After contact, the engagement actuators 140 may continue to urge the engagement plate 135 against the tubular 11, thereby increasing the contact force on the tubular 11.

Continuing to reference FIG. 5, during operation, the gripping tool 100 is lowered toward the tubular 11, which may be in a horizontal position or an inclined position. The gripping tool 100 may be rotated into alignment with the bore of the tubular 11. The mandrel 110 and the slips 155 are inserted into the tubular 11. The gripping actuator 160 is actuated to extend the piston 161, thereby moving the actuation sleeve 120 longitudinally relative to the mandrel 110. In turn, the slips 155 are moved along the incline, or wedges, of the mandrel 110, causing the slips to move radially as they move axially relative to sleeve 120. An activating source 210 supplies pressure fluid to actuate the gripping actuator 160. In this manner, the slips 155 are moved radially outward into engagement with the interior surface of the tubular 11. After gripping the tubular, the gripping tool 100 can be raised to lift the tubular 11. Lifting may include rotating the tubular 11 from a horizontal or inclined orientation to a vertical orientation.

Verification that the slips 155 are properly gripping the tubular 11 may be performed before lifting the tubular 11. For example, after the slips 155 have gripped the tubular 11, the engagement actuators 140 are actuated to move the engagement plate 135 into contact with the tubular 11. In this respect, the piston 141 of the engagement actuator 140 is extended to move the engagement plate 135 into contact with the top of the tubular 11. In the example of FIG. 5, the engagement actuators 140 may be actuated by pressure fluid from the same activating source 210 that supplies pressure fluid to actuate the gripping actuator 160. A sequence valve 215 delays the pressure fluid from actuating the engagement actuator 140 until the pressure reaches a predetermined level that is higher than the pressure for actuating the slips 155. In one example, the predetermined level of the sequence valve 215 may be set at 1,200 psi, and the actuating pressure of the gripping actuator 160 may be from about 300 psi to 900 psi. In one example, the pressure in the line to the gripping actuator 160 is sufficient to actuate the griping actuator 160, but below the predetermined level of the sequence valve 215. When the pressure in the line increases to the predetermined level, the sequence valve 215 allows the pressure fluid to be supplied to the engagement actuators 140. In this manner, the slips 155 can be actuated before the engagement plate 135 is actuated, using the same activating source 210. In another example, the sequence valve 215 can be set at a predetermined level from 1.25× to 5× greater than the pressure that actuates the gripping actuator 160.

After contacting the tubular 11, the engagement actuator 140 continues to act on the engagement plate 135, which in turn, causes the engagement plate 135 to increase the contact force applied against the tubular 11. In this respect, the engagement plate 135 attempts to move the tubular 11 relative to the slips 155. The applied force simulates the weight of one or more tubulars; for example, at least 100 lbs or from 100 lbs to 1,000 lbs or more. If extension of the piston 141 (or engagement plate 135) stops before reaching a predetermined distance, then it is an indication the slips 155 have properly gripped the tubular. In some embodiments, if the engagement plate 135 does not move relative to the mandrel 110 and/or the slips 155 in response to the increased contact force, then it is also an indication the slips 155 have properly gripped the tubular. A signal may be communicated to an interlock system 228 indicating the gripping tool 100 has an effective grip on the tubular 11.

In one example, the engagement actuator 140 remains actuated for the engagement plate 135 to continue to apply a force on the tubular 11 while the tubular 11 is being lifted. In this respect, the engagement plate 135 acts as a locking mechanism on the gripping tool 100, to prevent the slips from inadvertently disengaging from the tubular 11. In another example, the engagement plate 135 is retracted from the tubular, and the tubular 11 can be lifted to continue the operation.

The tubular 11 is lifted above a vertically oriented tubular string and aligned with tubular string before being lowered and stabbed or threaded into the tubular string. The tubular string may be held by a spider on the rig. In one embodiment, the engagement actuator 140 is de-actuated after stabbing the tubular 11. An optional thread compensator 225 may be used to facilitate makeup of the tubular 11 with the tubular string. In one example, the thread compensator 225 is configured to move the tubular 11 toward the tubular string in response to the makeup of the tubular 11 and the tubular string. In some embodiments, actuation of the thread compensator triggers the de-actuation of the engagement actuator 140. For example, as shown in FIG. 5, actuation of the thread compensator 225 can cause the directional valve 220 to shift, thereby placing the pressure fluid from the activating source 210 in fluid communication with the de-actuation side of the engagement actuator 140 and placing the actuation side of the engagement actuator 140 in fluid communication with the deactivating source 230. In some embodiments, the pressure is reduced prior to reaching the engagement actuator 140. Although the engagement actuator 140 is de-actuated, the slips 155 are still engaged with the tubular 11 to continue the tubular makeup operation. In some embodiments, the gripping tool 100 continues to signal to the interlock system that it has an effective good grip on the tubular 11.

After making up the tubulars, deactivating pressure from the deactivating source 230 is supplied to the gripping actuator 160 to de-actuate the slips 155. In one example, the pressure to de-actuate the slips 155 can be set at a range from 25% to 60% of the predetermined level of the sequence valve 215, for example, 500 psi. After deactivating the gripping actuator 160, the slips 155 may be pulled out of the tubular 11.

Referring to back to the verification process, if the piston 141 is extended past the predetermined distance, then it is an indication the slips 155 have not properly gripped the tubular 11. In this case, the operation is stopped to take remedial action. For example, the slips 155 may be disengaged, and the process of gripping the tubular 11 may be performed again.

Continuing to reference FIG. 5, in some embodiments, the gripping tool 100 includes a sensor to determine whether the piston 141 of the engagement plate 135 has extended beyond the predetermined distance. An exemplary sensor 175 includes a sensing port 170 fluidically coupled to a pilot valve 180 and a signal valve 190. Sensing port 170 is disposed at a prescribed location along the cylinder of the engagement actuator 140 and thereby defines the predetermined distance. In these examples, extending the piston 141 beyond the sensing port 170, i.e. beyond the predetermined distance, will place the sensing port 170 in fluid communication with the activating pressure that is in the cylinder of the engagement actuator 140. The activating pressure from port 170 will be communicated to the pilot valve 180, which will activate the signal valve 190. When the signal valve 190 is activated, an air inlet 195 is placed in communication with an air outlet 196. The air is supplied through the air outlet 196 to indicate the slips 155 are not properly gripping the tubular 11. In one example, the air is communicated to an interlock system which signals an improperly gripped tubular 11. Because engagement plate 135 is coupled for movement with piston 141, the sensor 175 is configured to determine a position of piston 141 or engagement plate 135 relative to the housing 115 or the mandrel 110.

In some other embodiments, a linear position sensor, a proximity sensor, or another suitable type of sensor is coupled to the piston 141 or the engagement plate 135 to determine a position of the piston 141 or a position the engagement plate 135 relative to the housing 115 or the mandrel 110. If the piston 141 or the plate 135 moves beyond a predetermined distance, then it is an indication the slips 155 are not properly gripping the tubular 1.

While embodiments disclosed herein relates to an internal gripping tool, it is contemplated aspects of the present disclosure may be used with other suitable external gripping tools or internal gripping tools. For example, the suitable external or internal gripping tools may be equipped with the gripping verification system disclosed herein.

In one embodiment, a tubular gripping tool for gripping a tubular includes a housing; a mandrel disposed in the housing; a plurality of slips movable along the mandrel; and an engagement member disposed in the housing and movable relative to the mandrel, wherein the engagement member is configured to apply a force against the tubular.

In one or more embodiments described herein, the tool includes an engagement actuator for moving the engagement member relative to at least one of the mandrel and the plurality of slips.

In one or more embodiments described herein, the tool includes a gripping actuator for moving the plurality of slips into gripping engagement with the tubular.

In one or more embodiments described herein, the engagement actuator comprises a piston and cylinder assembly configured to cause the engagement member to apply an axial force against the tubular.

In one or more embodiments described herein, the griping actuator is configured to actuate before engagement actuator.

In one or more embodiments described herein, the engagement member comprises an annular plate disposed about the mandrel.

In one or more embodiments described herein, the tool includes a sensor for determining a position of the engagement member.

In another embodiment, a method of gripping a tubular includes moving a slip to grip the tubular; moving an engagement member into contact with the tubular; causing the engagement member to apply a force against the tubular; and detecting whether the engagement member has moved beyond a predetermined distance relative to the slip after applying the force.

In one or more embodiments described herein, a piston and cylinder assembly is used to move the engagement member.

In one or more embodiments described herein, detecting whether the engagement member has moved beyond a predetermined distance comprises detecting a position of a piston of the piston and cylinder assembly.

In one or more embodiments described herein, the force is applied axially to an upper end of the tubular.

In one or more embodiments described herein, the method includes sending a signal to an interlock system indicating the slip is gripping the tubular if the engagement member has not moved beyond the predetermined distance.

In one or more embodiments described herein, the slip is actuated by a first pressure and the engagement member is actuated by a second, higher pressure.

In another embodiment, a method of connecting a first tubular to a second tubular includes gripping the first tubular using a slip; moving an engagement member into contact with the first tubular and applying a force against the first tubular by the engagement member; and detecting whether the engagement member has moved beyond a predetermined distance relative to the slip after applying the force; and connecting the first tubular to the second tubular.

In one or more embodiments described herein, the method includes lifting the first tubular while maintaining the force against the first tubular.

In one or more embodiments described herein, the method includes actuating a thread compensator to participate in connecting the first tubular to the second tubular.

In one or more embodiments described herein, the method includes actuating the thread compensator causes the engagement member to remove the force applied to the first tubular.

In one or more embodiments described herein, the slip is actuated by a first pressure and the engagement member is actuated by a second, higher pressure.

In one or more embodiments described herein, the method includes sending an engaged signal to an interlock system indicating the slip is gripping the tubular if the engagement member has not moved beyond a predetermined distance.

In one or more embodiments described herein, the method includes maintaining the engaged signal to the interlock system after removing the force applied against the first tubular by the engagement member.

While the foregoing is directed to embodiments of the present disclosure, other and further embodiments of the disclosure may be devised without departing from the basic scope thereof, and the scope thereof is determined by the claims that follow.

We claim:

1. A tubular gripping tool for gripping a tubular, comprising:

a housing;

a mandrel disposed in the housing;

a plurality of slips movable along the mandrel;

an actuation sleeve disposed around an exterior of the mandrel and configured to move the plurality of slips along an inclined surface of the mandrel;

a gripping actuator for moving the actuation sleeve, the gripping actuator having a rod extending through a bore of the mandrel and coupled to a lower portion of the actuation sleeve;

an engagement member disposed in the housing and movable relative to the mandrel and the plurality of slips, wherein the engagement member is configured to apply a force against the tubular; and an engagement actuator for moving the engagement member relative to the mandrel and the plurality of slips and applying the force against the tubular.

2. The tool of claim 1, wherein the gripping actuator is adapted to move the plurality of slips into gripping engagement with the tubular.

3. The tool of claim 1, wherein the engagement actuator comprises a piston and cylinder assembly configured to cause the engagement member to apply an axial force against the tubular.

4. The tool of claim 3, further comprising a sensor for detecting movement of a piston of the piston and cylinder assembly beyond a predetermined distance.

5. The tool of claim 1, wherein the gripping actuator is configured to actuate before the engagement actuator.

6. The tool of claim 1, wherein the engagement member comprises an annular plate disposed about the mandrel.

7. The tool of claim 1, further comprising a sensor for determining a position of the engagement member.

8. A method of gripping a tubular, comprising:

moving a slip to grip the tubular with sufficient gripping force to lift the tubular;

moving an engagement member into contact with an end of the tubular;

after gripping the tubular, causing the engagement member to apply an axial force against the end of the tubular, wherein application of the axial force exerts a pulling force on the slip toward the end of the tubular; and detecting whether the engagement member has moved beyond a predetermined distance relative to the slip after applying the axial force.

9. The method of claim 8, wherein a piston and cylinder assembly is used to move the engagement member.

10. The method of claim 9, wherein detecting whether the engagement member has moved beyond a predetermined distance comprises detecting a position of a piston of the piston and cylinder assembly.

11. The method of claim 10, wherein detecting the position of the piston comprises detecting the piston has moved past a sensing port.

12. The method of claim 8, wherein the force is applied axially to an upper end of the tubular.

13. The method of claim 8, further comprising sending a signal to an interlock system indicating the slip is gripping the tubular if the engagement member has not moved beyond the predetermined distance.

14. The method of claim 8, wherein the slip is actuated by a first pressure and the engagement member is actuated by a second, higher pressure.

15. A method of connecting a first tubular to a second tubular, comprising:

gripping the first tubular using a slip with sufficient gripping force to lift the tubular;

after gripping the first tubular, moving an engagement member into contact with the first tubular and applying an axial force against an end of the first tubular by the engagement member, wherein application of the axial force exerts a pulling force on the slip toward the end of the tubular;

detecting whether the engagement member has moved beyond a predetermined distance relative to the slip after applying the axial force; and connecting the first tubular to the second tubular.

16. The method of claim 15, further comprising lifting the first tubular while maintaining the force against the first tubular.

17. The method of claim 16, further comprising actuating a thread compensator to participate in connecting the first tubular to the second tubular.

18. The method of claim 17, wherein actuating the thread compensator causes the engagement member to remove the force applied to the first tubular.

19. The method of claim 15, wherein the slip is actuated by a first pressure and the engagement member is actuated by a second, higher pressure.

20. The method of claim 15, further comprising sending an engaged signal to an interlock system indicating the slip is gripping the tubular if the engagement member has not moved beyond the predetermined distance.

21. The method of claim 20, further comprising maintaining the engaged signal to the interlock system after removing the force applied against the first tubular by the engagement member.

* * * * *